US009701033B2

(12) United States Patent
Tracy

(10) Patent No.: US 9,701,033 B2
(45) Date of Patent: Jul. 11, 2017

(54) MULTI-HEADED SAFETY RAZOR

(71) Applicant: Prime 9 Shave, Inc., Batavia, NY (US)

(72) Inventor: Anthony Tracy, Westport, CT (US)

(73) Assignee: Prime 9 Shave, Inc., Batavia, NY (US)

( * ) Notice: Subject to any disclaimer, the term of this patent is extended or adjusted under 35 U.S.C. 154(b) by 249 days.

(21) Appl. No.: 14/211,890

(22) Filed: Mar. 14, 2014

(65) Prior Publication Data

US 2014/0259679 A1 Sep. 18, 2014

Related U.S. Application Data

(60) Provisional application No. 61/798,345, filed on Mar. 15, 2013.

(51) Int. Cl.
*B26B 21/22* (2006.01)
*B26B 21/52* (2006.01)

(52) U.S. Cl.
CPC ..... *B26B 21/225* (2013.01); *B26B 21/52* (2013.01); *B26B 21/521* (2013.01)

(58) Field of Classification Search
CPC ..... B26B 21/225; B26B 21/52; B26B 21/521; B26B 21/22; B26B 21/222; B26B 21/227
USPC ..... 30/50
See application file for complete search history.

(56) References Cited

U.S. PATENT DOCUMENTS

| | | | |
|---|---|---|---|
| 4,392,303 | A | 7/1983 | Ciaffone |
| 4,501,066 | A | 2/1985 | Sceberras |
| 4,753,006 | A | 6/1988 | Howe |
| 4,791,724 | A | 12/1988 | Dumas |
| 5,307,564 | A | 5/1994 | Schoenberg |
| 423,143 | A | 4/2000 | Cowell |
| 6,052,905 | A | 4/2000 | Branchinelli et al. |
| 6,308,416 | B1 * | 10/2001 | Bosy ..... B26B 21/225 30/50 |
| 6,560,876 | B2 | 5/2003 | Carr |
| 7,200,942 | B2 | 4/2007 | Richard |
| 7,721,451 | B2 | 5/2010 | Psimadas et al. |
| 8,205,344 | B2 | 6/2012 | Stevens |
| 8,387,259 | B2 | 3/2013 | Starr |
| 2002/0138992 | A1 | 10/2002 | Richard |
| 2011/0035950 | A1 | 2/2011 | Royle |
| 2011/0041342 | A1 | 2/2011 | Starr |

(Continued)

FOREIGN PATENT DOCUMENTS

| | | | |
|---|---|---|---|
| GB | 2353964 | A | 3/2001 |
| WO | 9725189 | A1 | 7/1997 |
| WO | 2006007873 | A1 | 1/2006 |

OTHER PUBLICATIONS

International Search Report from PCT/US2014/027905 mailed Jul. 28, 2014.

*Primary Examiner* — Phong Nguyen
(74) *Attorney, Agent, or Firm* — Carter, DeLuca, Farrell & Schmidt, LLP

(57) ABSTRACT

A safety razor is disclosed, and includes a handle and a shaving head. The shaving head defines a longitudinal axis. The shaving head is mounted to a distal portion of the handle and has a rest position. The shaving head is configured to rotate out of the rest position in a first radial direction transverse to the longitudinal axis defined by the handle. The shaving head is inhibited from rotation out of the rest position in a second radial direction opposite from the first radial direction.

7 Claims, 6 Drawing Sheets

(56) References Cited

U.S. PATENT DOCUMENTS

2014/0068948 A1* 3/2014 Marder ..... B26B 21/225
30/47

* cited by examiner

MULTI-HEADED SAFETY RAZOR

CROSS-REFERENCE TO RELATED APPLICATIONS

This application claims benefit of U.S. Provisional Application Ser. No. 61/798,345, filed Mar. 15, 2013, the entire contents of which are incorporated by reference herein.

BACKGROUND

1. Technical Field

The present disclosure relates to a razor for use in shaving a human or animal body. More particularly, the present disclosure relates to a safety razor incorporating multiple shaving heads being configured for limited rotation.

2. Background of Related Art

Safety razors typically incorporate a shaving head having one or more straight cutting edges or blades to sever or shorten hairs growing on a body surface, e.g., of a human or animal. The shaving process typically requires multiple passes, or strokes, of the shaving head over body surface areas to satisfactorily remove or shorten hairs from a desired body surface.

Safety razors may be employed on regions of a body having large surface areas, e.g., the chest, legs, or scalp. Additionally, shaving razors may be used on areas incorporating pronounced curvatures or irregular geometries, e.g., the head, ankles, knees, or calves of a human body. Accordingly, it would be desirable to provide a safety razor that is configured to cover a large surface area of a body for shortening or removing hairs therefrom, while being dynamically responsive to the curvature or geometry of various body surfaces.

SUMMARY

According to one aspect of the present disclosure, a safety razor is disclosed, and includes a handle and at least one shaving head. The shaving head is mounted adjacent to a distal portion of the handle and has a rest position. The shaving head is configured to rotate out of the rest position in a first radial direction transverse to a longitudinal axis defined by the handle. The shaving head is inhibited from rotation out of the rest position in a second radial direction opposite from the first radial direction.

According to another aspect of the present disclosure, the shaving head is detachably mounted to a distal portion of the handle. In one aspect of the present disclosure, the shaving head is laterally spaced from the handle by a connecting member. In another aspect of the present disclosure, the safety razor further includes a biasing member configured to maintain the shaving head in the rest position.

In yet another aspect of the present disclosure, the safety razor further includes a second shaving head being mounted adjacent to a distal portion of the handle. The second shaving head may have a rest position. The second shaving head is configured to rotate out of the rest position in the second radial direction. The second shaving head may be inhibited from rotation out of the rest position in the first radial direction.

According to another aspect of the present disclosure, a safety razor is disclosed including a handle, a connecting member, a mounting arm, and a shaving head. The handle defines a longitudinal axis, and the connecting member extends away from the handle. The mounting arm is disposed on the connecting member, and includes a stop. The shaving head is mounted to the mounting arm and has a rest position. The shaving head is configured to rotate out of the rest position in a first radial direction transverse to the longitudinal axis defined by the handle. The shaving head is inhibited from rotation out of the rest position in a second radial direction opposite from the first radial direction upon engaging the stop.

According to another aspect of the present disclosure, the shaving head is detachably mounted to the mounting arm. In another aspect of the present disclosure, a release mechanism is provided to uncouple the shaving head from the mounting arm.

In yet another aspect of the present disclosure, the safety razor further includes a biasing member, wherein the biasing member is disposed within the mounting arm. A mounting collar may be partially disposed within the mounting arm and engaging the shaving head. The biasing member may include a leg configured to engage a portion of the mounting collar. The mounting collar may include a stop configured to engage the stop of the mounting arm.

According to another aspect of the present disclosure, the safety razor further includes a second shaving head mounted adjacent to a distal portion of the handle. The second shaving head may have a rest position. The second shaving head is configured to rotate out of the rest position in the second radial direction transverse to the longitudinal axis defined by the handle. The second shaving head may be inhibited from rotation out of the rest position in the first radial direction opposite from the second radial direction. In another aspect of the present disclosure, the shaving head may include a base portion and a frame portion.

According to another aspect of the present disclosure, a safety razor is disclosed, and includes a handle, a first connecting member, a second connecting member, a first shaving head, a second shaving head, and a third shaving head. The handle defines a longitudinal axis, and the first and second connecting members extend away from the handle. The first shaving head is detachably coupled with the first connecting member and defines a first rest position. The second shaving head is detachably coupled with the second connecting member and defines a second rest position. The third shaving head is detachably coupled with a distal portion of the handle. The first shaving head is configured to rotate in a first radial direction transverse to the longitudinal axis from the first rest position, and is inhibited from rotation in a second radial direction transverse to the longitudinal axis from the first rest position. The first radial direction is opposite the second radial direction. The second shaving head is configured to rotate in the second radial direction transverse to the longitudinal axis from the second rest position, and is inhibited from rotation in the first radial direction transverse to the longitudinal axis from the second rest position. In another aspect of the present disclosure, the third shaving head may be configured to rotate in either or both of the first and second radial directions.

According to another aspect of the present disclosure, a kit is disclosed, and includes a safety razor, at least one additional shaving head not mounted to the safety razor. And a container of a shaving composition. The safety razor includes a handle and at least one shaving head. The shaving head is mounted adjacent to a distal portion of the handle and has a rest position. The shaving head is configured to rotate out of the rest position in a first radial direction transverse to a longitudinal axis defined by the handle. The shaving head is inhibited from rotation out of the rest position in a second radial direction opposite from the first radial direction.

BRIEF DESCRIPTION OF THE DRAWINGS

Embodiments of the present disclosure are described herein with reference to the accompanying drawings, wherein.

DETAILED DESCRIPTION OF EMBODIMENTS

Figure 1:
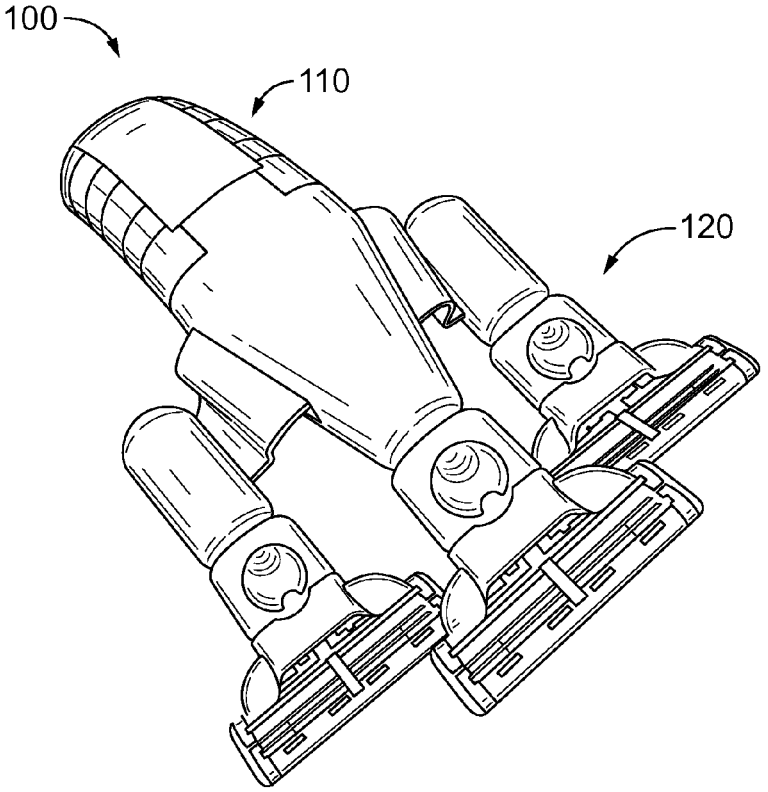
FIG. 1 is a front perspective view of a safety razor according to the present disclosure.

Embodiments of the presently disclosed razor are described in detail with reference to the drawings, in which like reference numerals designate identical or corresponding elements in each of the several views. As used herein the term "distal" refers to that portion of the safety razor, or component thereof, that is farther from the user, while the term "proximal" refers to that portion of the safety razor, or component thereof, that is closer to the user.

Figure 2:
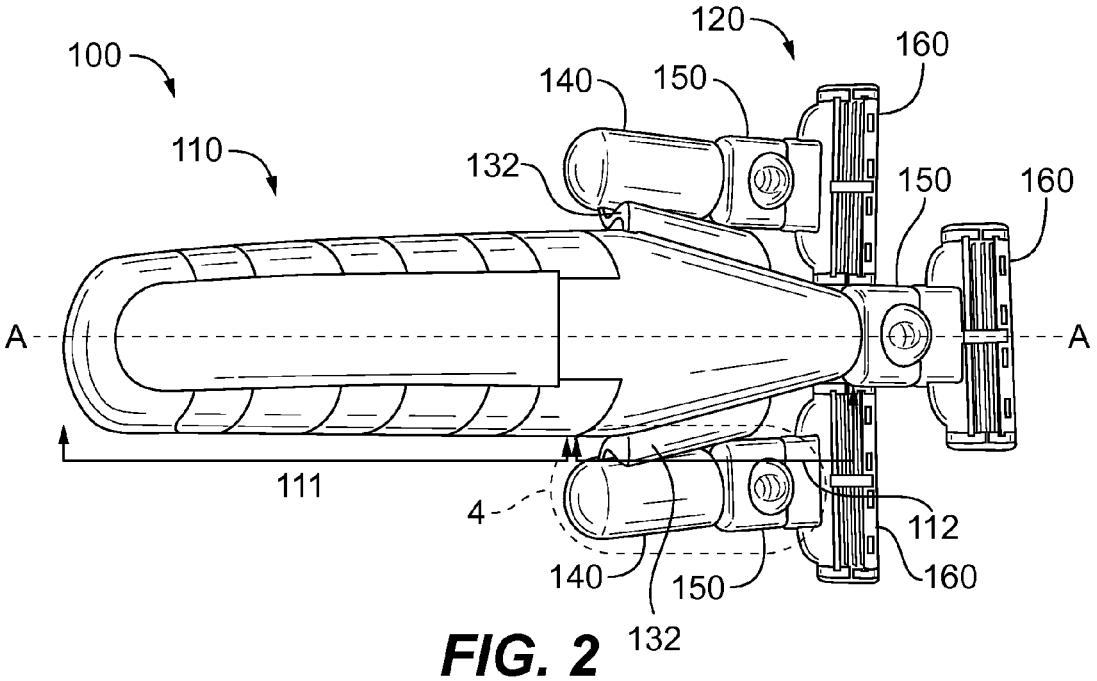
FIG. 2 is a top plan view of the safety razor of FIG. 1.

Referring initially to FIGS. 1 and 2, a safety razor 100 is shown. Safety razor 100 includes a handle 110 and a shaving portion 120. Handle 110 defines a proximal portion 111 and a distal portion 112. Distal portion 112 of handle 110 defines a longitudinal axis "A." Handle 110 may have a curvate or otherwise ergonomically-configured profile for manual grasping by a user. Further, handle 110 may include surface features/textures, e.g., bumps, grooves, or ridges, to enhance surface contact between a user's hand and handle 110, e.g., to minimize slippage or enhance comfort.

Shaving portion 120, as shown, includes a pair of mounting arms 140 being laterally spaced away from and opposing handle 110 by a pair of connecting members 132. Each mounting arm 140 includes a mounting collar 150. Additionally, a mounting collar 150 is coupled to the distal portion 112 of handle assembly 100. Each mounting collar 150 is configured to receive a shaving head 160.

Figure 3:
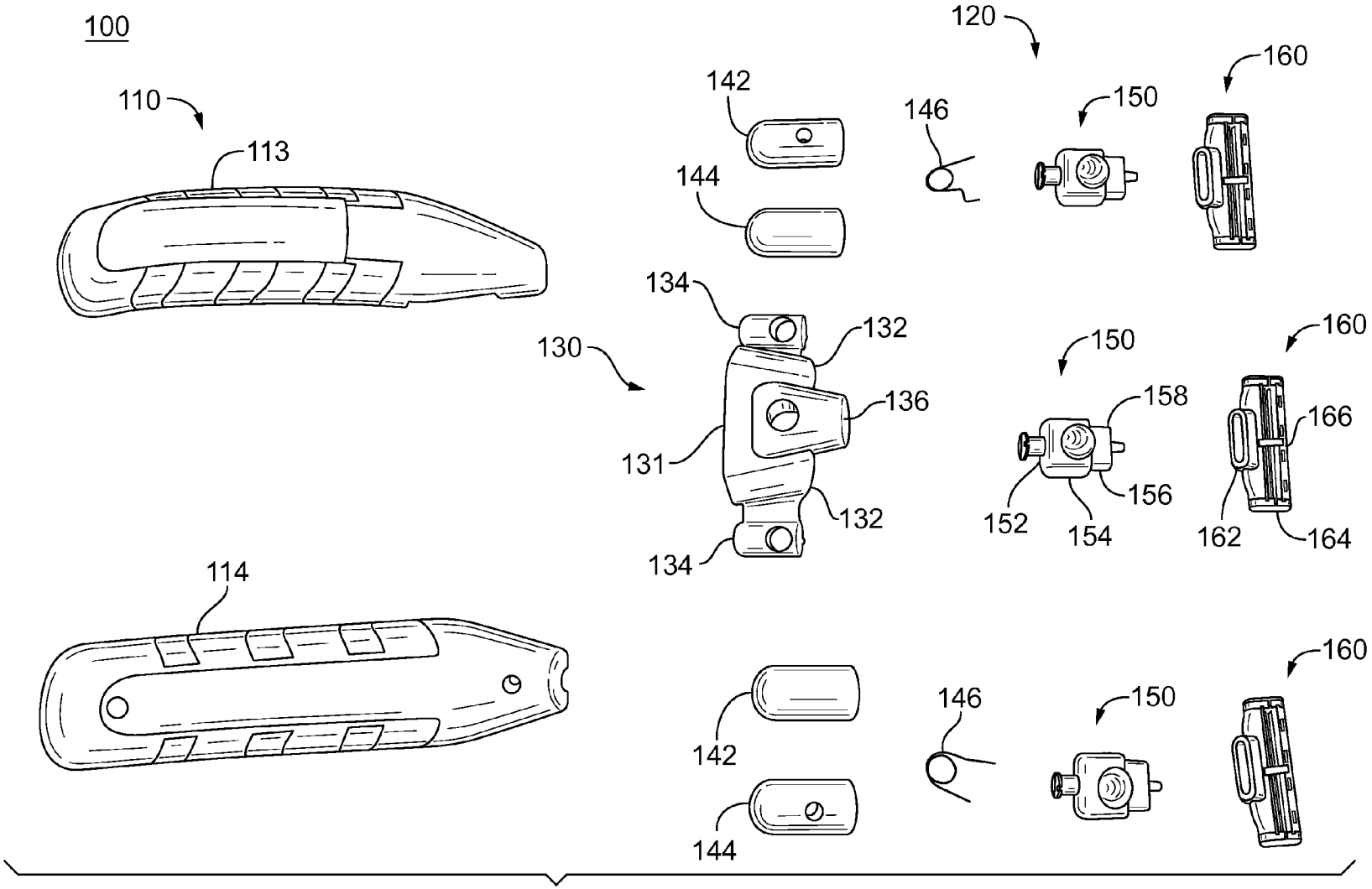
FIG. 3 is a parts-separated view of the safety razor of FIG. 1.

Turning now to FIG. 3, the components of safety razor 100 are shown in parts-separated view. Handle 110 of safety razor 100 may be formed of separate half-housings 113, 114. Half-housings 113, 114 may define substantially hollow members for accommodating other components of safety razor 100, as will be described further below. Half-housings 113, 114 may have a complementary configuration, i.e., a substantially similar curvature, as shown, and are configured for coupling to form handle assembly 110. Accordingly, half-housings 113, 114 may be snap-fit, press-fit, ultrasonically welded, or otherwise coupled as is known in the art.

Half-housings 113, 114 are configured to receive a mounting member 130, which includes a substantially flat central portion 131 and connecting members 132 extending laterally from opposing sides thereof. Connecting members 132 extend laterally outward and downward from the central portion 131. Each connecting member includes a coupling area 134 at an end portion thereof configured for engaging with respective mounting arms 140, as will be described further below. Mounting member 130 also includes a distal extension 136, which is configured for coupling with a mounting collar 150, as will be described further below.

Figure 4:
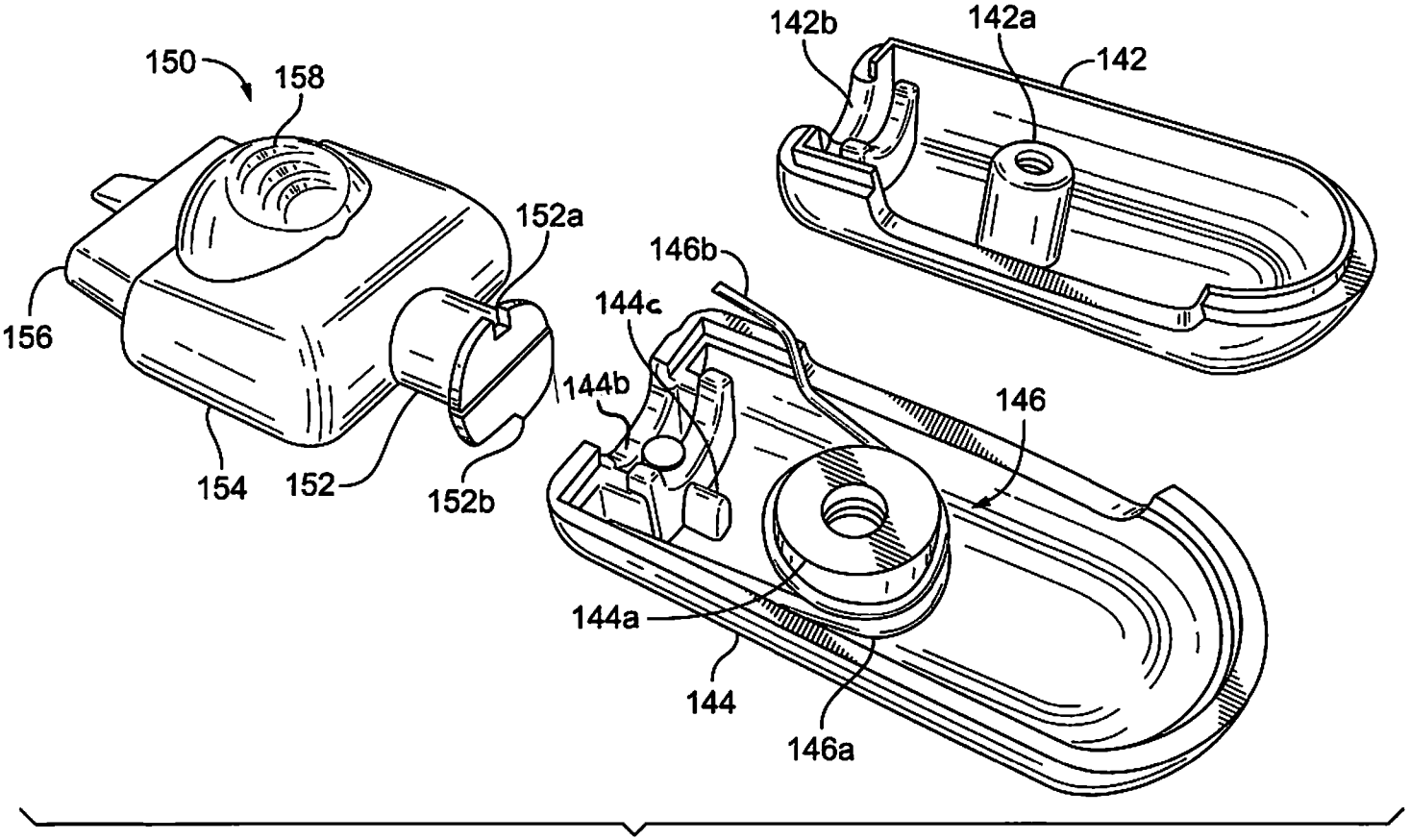
FIG. 4 is a perspective, parts-separated view of the area of detail identified in FIG. 2.

Referring additionally to FIG. 4, mounting arms 140, as shown, may be formed from half-sections 142, 144 that are configured to couple about the coupling area 134 of each respective connecting member 132. Half-sections 142, 144 of the mounting arms 140 each define a hollow interior such that the coupling area 134 of each respective connecting member 132 is disposed therein. Half-section 142 of mounting arm 140 includes a receiving mold 142*a* and half-section 144 of mounting arm 140 includes a molded pin 144*a* for insertion into the receiving mold 142*a* upon coupling of half-sections 142, 144. Half-section 142 also includes a distal collar 142*b* that is configured to receive a portion of a mounting collar 150, as will be described further below. Half-section 144 also includes a distal collar 144*b* that is similarly configured to receive a portion of a mounting collar 150.

Each mounting arm 140 also includes a biasing member 146. Biasing member 146 may be a resilient member configured to return to a resting condition following the application of an external force, e.g., a spring. Biasing member 146 may be configured as, e.g., a torsion spring, and includes a body 146*a* that is circumferentially disposed around the receiving mold 142*a* and a leg 146*b* for engaging a portion of a mounting collar 150, as will be described further below. Accordingly, biasing member 146 is formed of a resilient material, e.g., plastic, aluminum or steel.

Each mounting arm 140 is configured to receive a mounting collar 150. Mounting collars 150, as shown, include a proximal portion 152, a central portion 154, and a distal portion 156. The proximal portion 152 of each mounting collar 150 is configured to be disposed within the distal collars 142*b*, 144*b*, of mounting arms 140. The distal portion 156 of each mounting collar 150 is configured for detachable coupling with a shaving head 160, as will be described further below. Accordingly, each mounting collar 150 may incorporate a release mechanism 158, e.g., a button, lever, or switch, that is operable to disengage a shaving head 160 from the mounting collar 150. Accordingly, safety razor 100 incorporates a modular design such that replacement shaving heads 160, or alternative shaving heads, may be used during the operational life of the safety razor 100.

Additionally, the distal extension 136 of mounting member 130 is configured to receive a mounting collar 150. A shaving head 160 may be detachably coupled to the mounting collar 150 of the distal extension 136 in the manner described above. Accordingly, a shaving shaving head 160 may be detachably coupled to a distal end 112*a* (FIG. 5A) of the distal portion 112 of the handle 110.

Shaving heads 160 include a base portion 162 configured for detachable engagement with the distal portion 156 of each mounting collar 150 as described above. Extending distally from the base portion 162 of shaving heads 160 is a frame portion 164 accommodating one or more linear blades 166. Blades 166 may be disposed, i.e., arranged and angled, within the frame portion 164 such that the shaving head may be passed, pulled, or dragged over a body surface such that the blades 166 engage hairs protruding from a body surface for the purpose of shortening or severing the hairs. Blades 166 are arranged and angled within the frame portion 164 such that the blades 166 pose a minimal risk e.g., of cutting or nicking a body surface, or pulling on hair protruding therefrom. In this manner, frame portion 164 may define or incorporate a blade guard. Accordingly, blades 166 are formed of a material configured to engage hairs growing from a body surface and are inhibited from corrosion or accruing substantial material defects during multiple uses, e.g., amorphous steel.

Figure 5A:
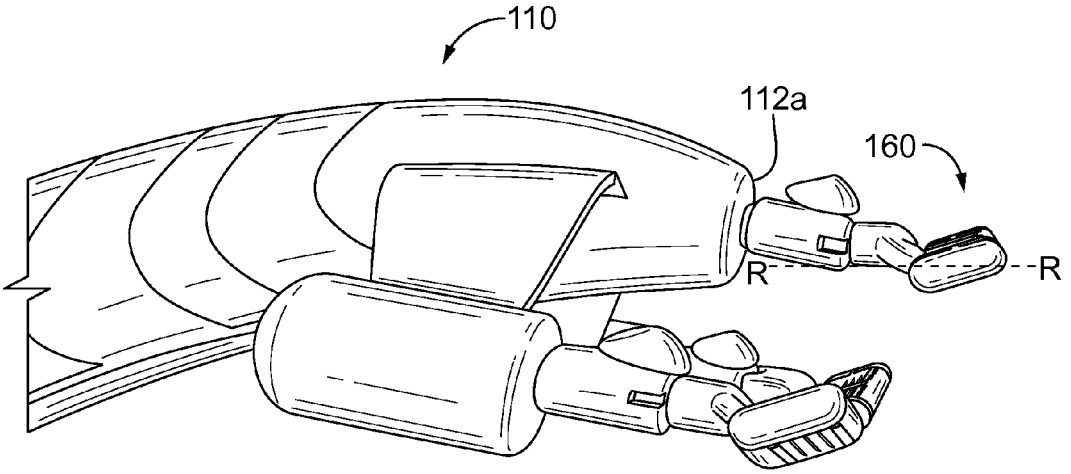
FIG. 5A is a side view of the safety razor of FIG. 1.
Figure 5B:
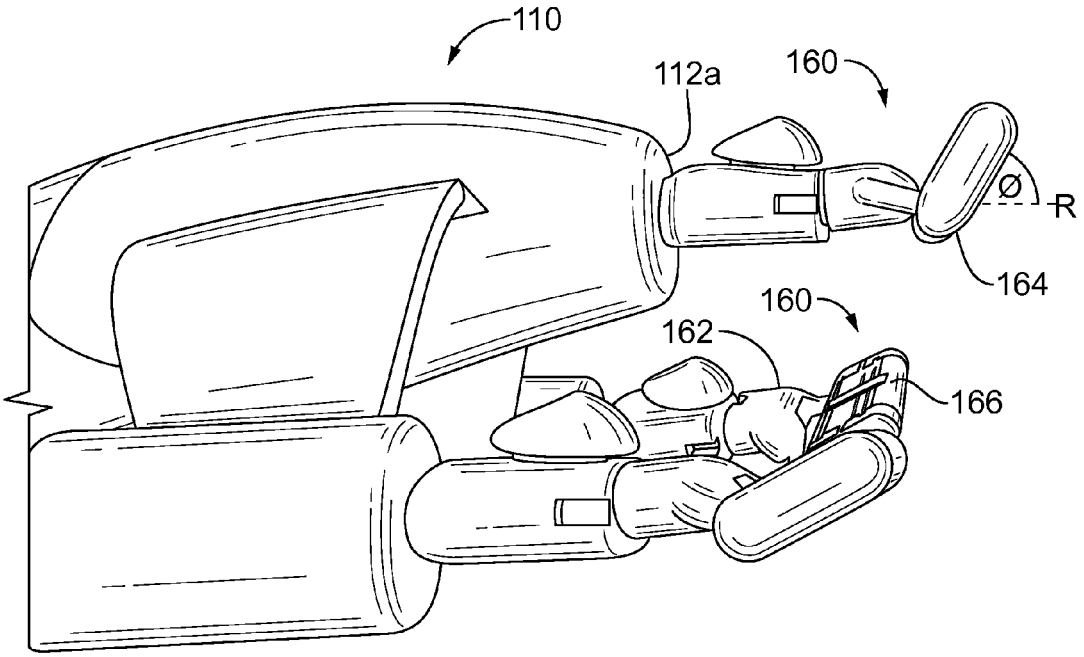
FIG. 5B is a side view of the safety razor of FIG. 1, showing shaving heads being pivoted from a first position.

Additionally, the frame portion 164 of shaving heads 160 may be configured to flex or pivot with respect to the base portion 162 of shaving heads 160. Accordingly, shaving heads 160 may incorporate a hinge, e.g., a living hinge or leaf spring (not shown), between the base portion 162 and frame portion 164. Turning now to FIGS. 5A and 5B, the frame portions 164 of the respective shaving heads 160 are shown in a first position (FIG. 5A) and a second position (FIG. 5B). In the first position, the frame portions 164 of the respective shaving heads 160 define an axis "R." The frame portions 164 of the respective shaving heads 160 may pivot with respect to the respective base portions 162 in response to an externally-applied force, e.g., a downward force translated through handle 110 of safety razor 100 by a user during the course of shaving a body surface, i.e., a user may apply downward pressure on the handle 110, causing the frame portions 164 of the respective shaving heads 160 to be forced against a body surface. Such an externally-applied force may be encountered, e.g., by an increase of the angle of incidence of a shaving head 160 with a body surface, or an increase of pressure on the handle 110 by a user, e.g., to reach proximal portions of hairs protruding from a body surface to "get a closer shave." In response, the frame portions 164 of the respective shaving heads 160 may pivot to an angle θ with respect to axis "R." Angle θ may be, e.g., an oblique or perpendicular angle measured relative to axis "R."

Figure 6A:
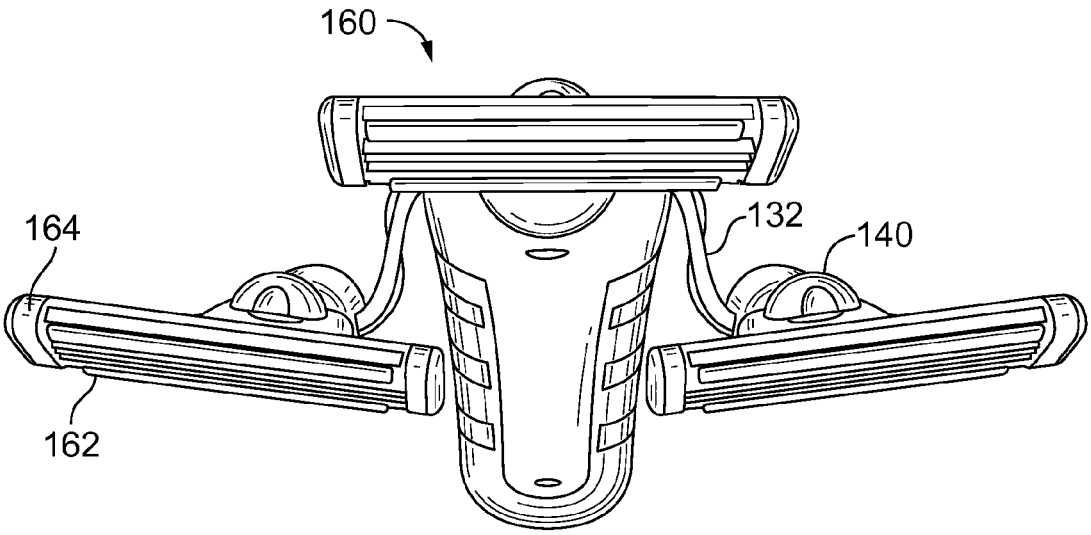
FIG. 6A is a front perspective view of the safety razor of FIG. 1.
Figure 6B:
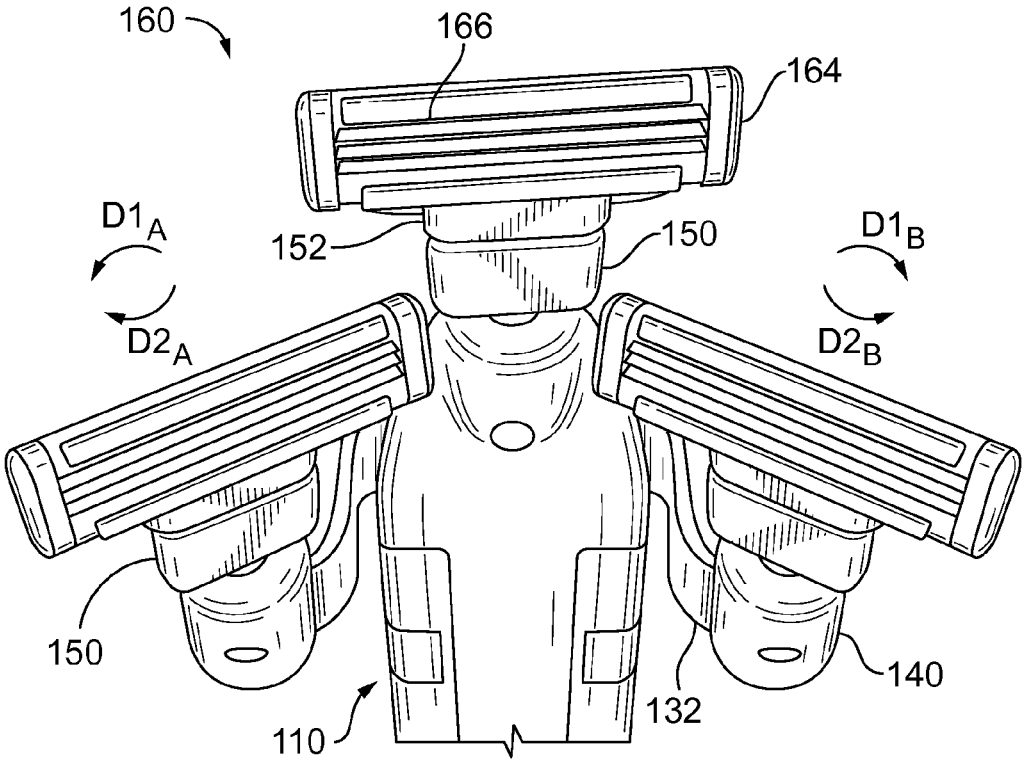
FIG. 6B is a front perspective view of the safety razor of FIG. 1, showing shaving heads being rotated from a rest position.

Turning now to FIGS. 6A and 6B, an additional reconfigurable feature of the safety razor 100 will be shown. As described above, shaving heads 160 are afforded a degree of rotation along a direction transverse to the longitudinal axis "A" (FIG. 1). Shaving heads 160 rotate with respect to mounting arms 140 upon application of an external force e.g., a downward force translated through handle 110 of safety razor 100 by a user during the course of shaving a body surface, i.e., a user may apply downward pressure on the handle 110, causing the frame portions 164 of the respective shaving heads 160 to be forced against a body surface as described above. Such an externally-applied force may be generated as the shaving heads 100 are passed over, e.g., a curvate or irregularly-shaped portion of a human or animal body. Accordingly, the shaving heads 160 coupled to mounting arms 140 may transition between a rest position (FIG. 6A) and a rotated position (FIG. 6B). With additional reference to FIGS. 3 and 4, as a shaving head 160 rotates, the mounting collar 150 to which it is coupled is also caused to rotate. The proximal portion 152 of mounting collar 150 incorporates a notch 152*a* for receiving the leg 146*b* of the biasing member 140. Thus, as the distal portion 153 of mounting collar 150 rotates within the half-sections 142, 144 of the mounting arms 140 under an externally-applied force, the biasing member 146 is compressed and provides a counterforce tending to return the mounting collar 150, and thereby the shaving head 160, to its rest position.

The proximal portion 152 of each mounting collar 150 may also incorporate a stop 152*b* corresponding to a stop 144*c* of the housing half-section 144 of mounting arm 140. Stop 144*c* may be a molded portion of the interior surface of housing half-section 144, or may be a separate element attached to the housing half-section 144. As the stop 152*b* of the proximal portion 152 of each mounting collar 150 engages the stop 144*c* of each respective housing half-section 144 of each mounting arm 140, the proximal portions 152 of each mounting collar 150, and thereby shaving heads 160, are inhibited from further rotation therethrough. In this manner, each shaving head 160 is configured to rotate in a respective first radial direction $D1_A$, $D1_B$ from its rest position, and each shaving head 160 is inhibited from rotation in a respective second radial direction $D2_A$, $D2_B$ from its rest position via the respective stops 144*c* of the housing half-sections 144 of each mounting arm 140. It is noted that first radial direction $D1_A$ is radially opposite second radial direction $D2_A$, i.e., clockwise and counterclockwise, and first radial direction $D1_B$ is radially opposite second radial direction $D2_B$. Radial directions $D1_A$, $D2_A$, $D1_B$, $D2_B$ may be defined through any predetermined range of motion. In embodiments, shaving heads 160 may rotate from about 10 degrees to about 120 degrees.

As described above, a shaving head 160 is mounted to the distal extension 136 of mounting member 130, and may incorporate a biasing member 146 as described above with respect to the shaving heads 160 mounted to the mounting arms 140. In some embodiments, the mounting collar 150 coupled with the distal extension 136 of the mounting member 130 may be configured to rotate or swivel in any radial direction, i.e., radial directions $D1_A$, $D2_A$, $D1_B$, $D2_B$. In some embodiments, a mounting collar 150 may be fixedly coupled with the distal extension 136 of mounting member 130. In this manner, the safety razor 100 defines first, second, and third shaving heads 160 that are dynamically responsive during use to accommodate large and irregular surface areas to facilitate the shaving process.

Figure 7:
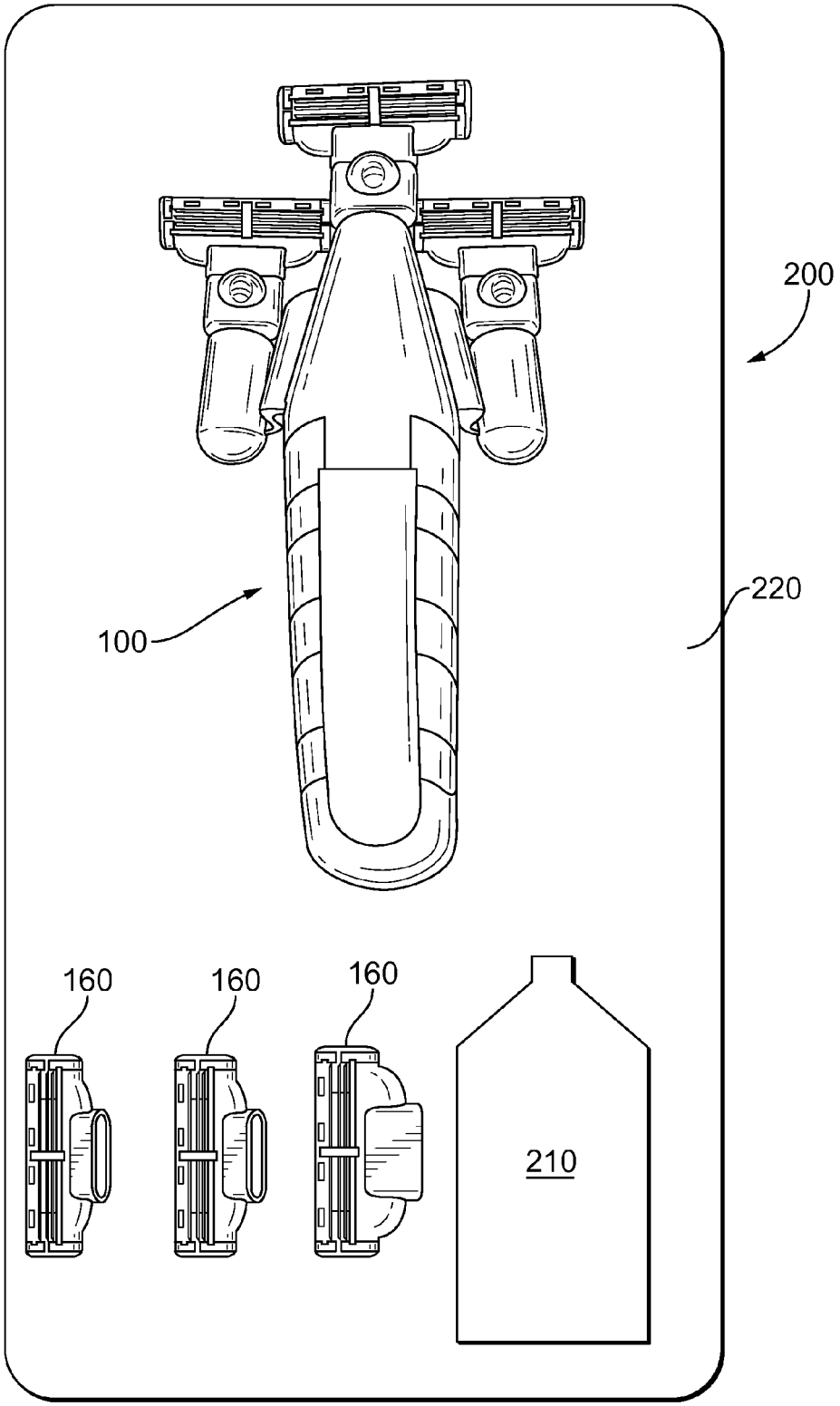
FIG. 7 is a top plan view of a kit including the safety razor of FIG. 1.

Turning to FIG. 7, each of the above-described components of the safety razor 100 described above may be included with a kit 200 to ensure that a user is provided with a variety of components useful for shaving. Kit 200 may include at least one additional shaving head 160 for detachable coupling with the safety razor 100 as described above. Kit 200 may also include a container 210 of shaving composition. The composition may be any suitable substance for disposition on a body surface of a user to facilitate hair removal by shaving heads 160, e.g., a soap, lubricant, moisturizer, or hair softener. Accordingly, the shaving composition may be, e.g., a foam, gel or solid bar. Kit 200 may be packaged in any suitable container 220, e.g., a bag, box, or carrying case. Alternatively, the components of the kit 200 may be nested into preformed recesses in a thermoformed package. It will be understood that some or all of the above-described components may be included in kit 200 in any desirable combination.

It will be understood that various modifications may be made to the embodiments disclosed herein. The various components of safety razor 100 described above may be formed of any suitable materials for their discussed purposes, e.g., polymeric or metallic materials. It will also be understood that the various components of safety razor 100 described above may be coupled in any suitable manner known in the art, e.g., screws, pins, or by welding. It will further be understood that safety razor 100 may be configured to receive less than three, or more than three shaving heads 160. Therefore, the above description should not be construed as limiting, but merely as exemplifications of preferred embodiments. Those skilled in the art will envision other modifications within the scope and spirit of the claims appended thereto.

The invention claimed is:

1. A safety razor, comprising:

a handle defining a longitudinal axis;

a connecting member extending away from the handle;

a mounting arm disposed on the connecting member; the mounting arm including a stop;

a shaving head mounted to the mounting arm and having a rest position, the shaving head being configured to rotate out of the rest position in a first radial direction transverse to the longitudinal axis defined by the handle;

a mounting collar partially disposed within the mounting arm and engaging the shaving head, the mounting collar including a stop configured to engage the stop of the mounting arm; and a biasing member disposed within the mounting arm, the biasing member including a leg configured to engage a portion of the mounting collar, the shaving head being inhibited from rotation out of the rest position in a second radial direction opposite from the first radial direction upon engaging the stop.

2. The safety razor of claim 1, wherein the shaving head is detachably mounted to the mounting arm.

3. The safety razor of claim 1, further comprising a release mechanism to uncouple the shaving head from the mounting arm.

4. The safety razor of claim 1, further comprising a second shaving head being mounted to a distal portion of the handle.

5. The safety razor of claim 4, wherein the second shaving head has a rest position, the second shaving head being configured to rotate out of the rest position in the second radial direction, and the second shaving head is inhibited from rotation out of the rest position in the first radial direction.

6. The safety razor of claim 4, further comprising a third shaving head mounted to a distal portion of the handle.

7. The safety razor of claim 1, wherein the shaving head includes a base portion and a frame portion, the frame portion being pivotable with respect to the base portion.

* * * * *